United States Patent [19]

Varma

[11] Patent Number: 4,858,336

[45] Date of Patent: Aug. 22, 1989

[54] HAIR DRYER

[76] Inventor: Shivendra Varma, 2 McFadden Drive, Brampton, Ontario, Canada, L6Z 3H4

[21] Appl. No.: 160,287

[22] Filed: Feb. 25, 1988

[51] Int. Cl.[4] ..... F26B 19/00

[52] U.S. Cl. ..... 34/90; 312/227

[58] Field of Search ..... 34/90, 91, 97; 312/224, 312/225, 226, 227

[56] References Cited

U.S. PATENT DOCUMENTS

| | | | |
|---|---|---|---|
| 3,449,838 | 6/1969 | Chancellor | 34/90 |
| 3,612,824 | 10/1971 | Berryman | 34/97 X |
| 4,701,594 | 10/1987 | Powell | 34/97 X |

*Primary Examiner*—Henry A. Bennet

*Attorney, Agent, or Firm*—Sim & McBurney

[57] ABSTRACT

A wall-mounted hair dryer appropriate for mounting in bathrooms with limited wall space comprises a housing contain a fan unit, an air flow divider which produces two air flows, and an electric heating unit which heats one of the air flows. A flexible conduit assembly directs the two air flows to a nozzle, and includes an inner conduit which conveys the heated air flow and an outer conduit which conveys the cooler air flow thereby ensuring that the exterior of the conduit assembly remains cool to the user's touch. The air flows are combined within the nozzle to reduce temperature of the discharged air. A frame is hinged to the housing and normally seats in a recess formed in a forward surface of the housing. A two-sided mirror assembly is mounted in a central opening formed in the frame for pivoting movement about a horizontal axis. An electrically-operable lighting unit including appropriate reflectors projects light to opposing sides of the frame thereby illuminating either of the mirror surfaces. The user has access to a mirrored surface and appropriate illumination despite location of the hair dryer where required by space constraints.

26 Claims, 4 Drawing Sheets

HAIR DRYER

FIELD OF THE INVENTION

The invention relates generally to hair dryers, and has particular application to wall-mounted hair dryers.

DESCRIPTION OF THE PRIOR ART

Wall-mounted hair dryers comprising a housing containing an air flow producer and heating element are known. These commonly include an external conduit which delivers heated air flows to a nozzle, the conduit being flexible to permit the user to manipulate the nozzle as desired. Such hair dryers are preferably mounted where an individual can readily access a mirror for purposes of hairstyling.

Mounting such hair dryers in bathrooms can pose problems. Bathrooms provided in a hotel, for example, are often very small and often have very limited wall space to which a hair dryer can be mounted. Depending on the particular configuration of the bathroom, it may be difficult to provide a guest with proper access to a mirror during hair drying. To ensure that a user always has access to a mirror, it would be desirable that the hair dryer itself provide such a mirror. Given space limitations, however, it may be difficult to mount the hair dryer so that the associated mirror is properly presented. An additional problem associated with such prior hair dryers is that the conduit which conducts heated air flows to the nozzle tends to become excessively hot to the user's touch.

It would be desirable to provide a hair dryer which can provide a properly oriented mirrored surface for use by a hotel patron regardless where the hair dryer is mounted and which avoids subjecting a user to hot surfaces while manipulating an extension conduit which directs heated air flows to a nozzle.

BRIEF SUMMARY OF THE INVENTION

In one aspect, the invention provides a hair dryer comprising a housing containing means for producing a flow of heated air. The hair dryer includes a nozzle and conduit means which direct at least the heated air flows from the housing to the nozzle, the conduit means being sufficiently flexible as to permit movement of the nozzle relative to the housing. A frame is hinged to the housing such that the frame moves between a closed orientation in which the frame is located against a forward surface of the housing (preferably in a recessed surface portion where the frame can be unobtrusively located), and an open orientation in which the frame is separated from and angled relative to the forward housing surface. A mirror assembly is mounted to the frame, preferably within a central opening formed in the frame, for pivoting movement about a predetermined axis relative to the frame. The mirror assembly preferably has opposing mirrored surfaces. Accordingly, the hair dryer can be mounted on any convenient wall surface, and both the frame and the mirror assembly can be appropriately pivoted to permit a user access to a mirrored surface during hair drying.

In another aspect, the invention provides a hair dryer comprising a housing which contains an air flow producing means that produces both a heated air flow and a relatively cool air flow. A conduit assembly connects a nozzle to the housing and is sufficiently flexible as to permit movement of the nozzle by hand relative to the housing. The conduit assembly includes an inner conduit which delivers the heated air flow to the nozzle and an outer conduit which defines an air flow passage surrounding the inner conduit through which the cool air is guide about at least the majority of the length of the inner conduit. Accordingly, the exterior of the conduit assembly tends to remain cool to the user's touch. The heated and relatively cool air flows are preferably combined within the nozzle to reduce the temperature of the discharge air flows and of the nozzle itself.

Other aspects and advantages associated with the present invention will be apparent from a description below of a preferred embodiment and will be more specifically defined in the appended claims.

DESCRIPTION OF THE DRAWINGS

The invention will be better understood with reference to drawings in which.

DESCRIPTION OF PREFERRED EMBODIMENT

Figure 1:
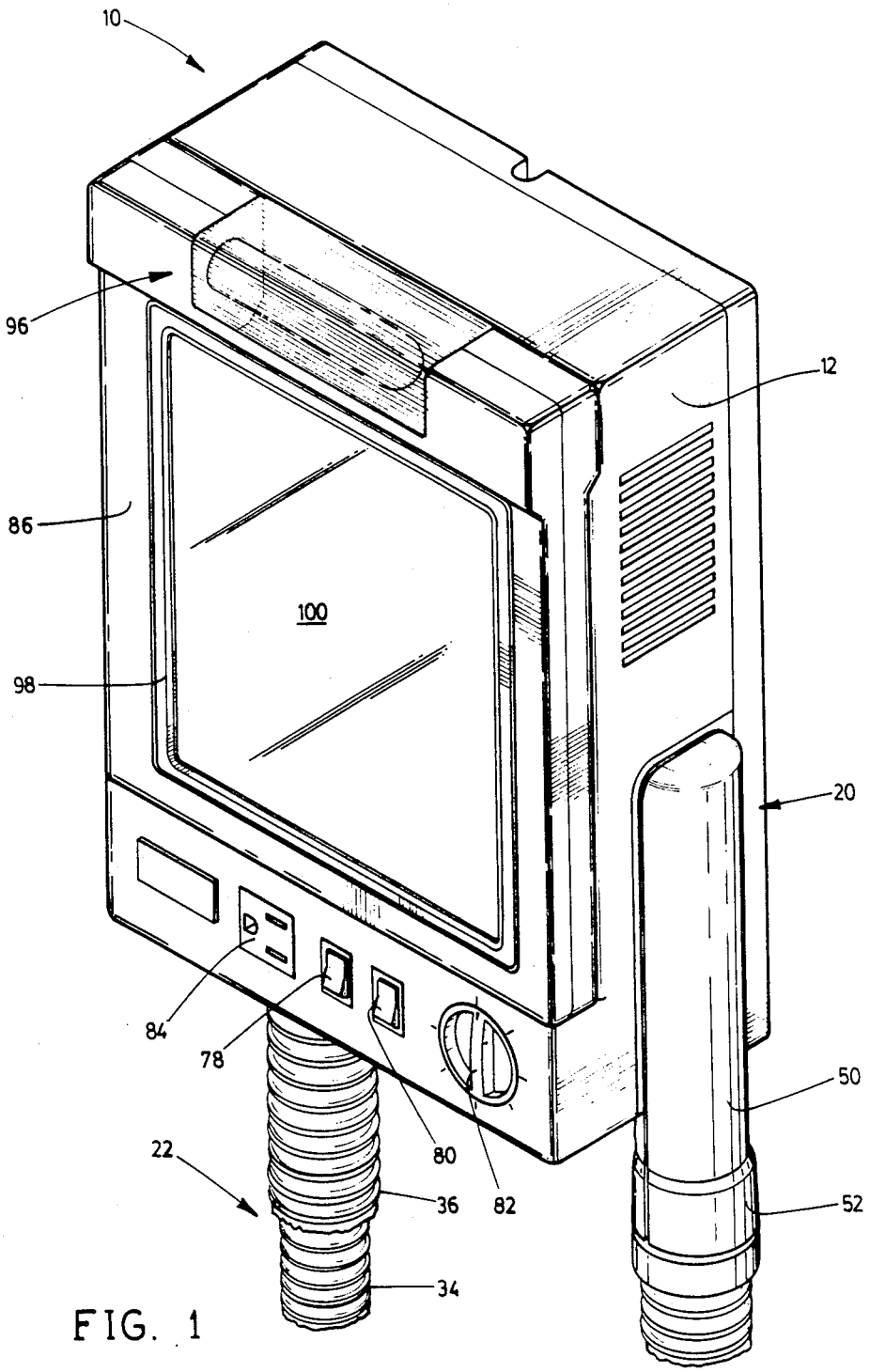
FIG. 1 is a perspective view of a hair dryer in which an assembly of air directing conduits has been shown extensively fragmented.

The drawings illustrate a hair dryer 10 which includes a housing 12 with a flat rear surface 14 appropriate for wall-mounting and a forward surface 16 including a recessed upper surface portion 18 in which a mirror assembly is mounted. The hair dryer 10 also includes a nozzle 20 and a flexible plastic conduit assembly 22 which connects the nozzle 20 to the housing 12 and which directs air flows produced in the interior of the housing 12 to the nozzle 20. The housing 12, nozzle 20, and various structural components associated with the hair dryer 10 are formed of plastic.

The housing 12 contains a fan 24 which receives ambient room air through appropriate apertures provided in the housing 12 and which directs an air stream towards a flow divider 26. The flow divider 26 comprises an outer frustoconical shell 28 and an inner concentric frustoconical shell 30 which together divide the air stream into inner and outer air flows. An electric heating element 32 formed of conventional resistance wire is mounted in the interior of the inner shell 30 and serves to heat the inner air flow, the outer air flow remaining relatively cool.

Figure 6:
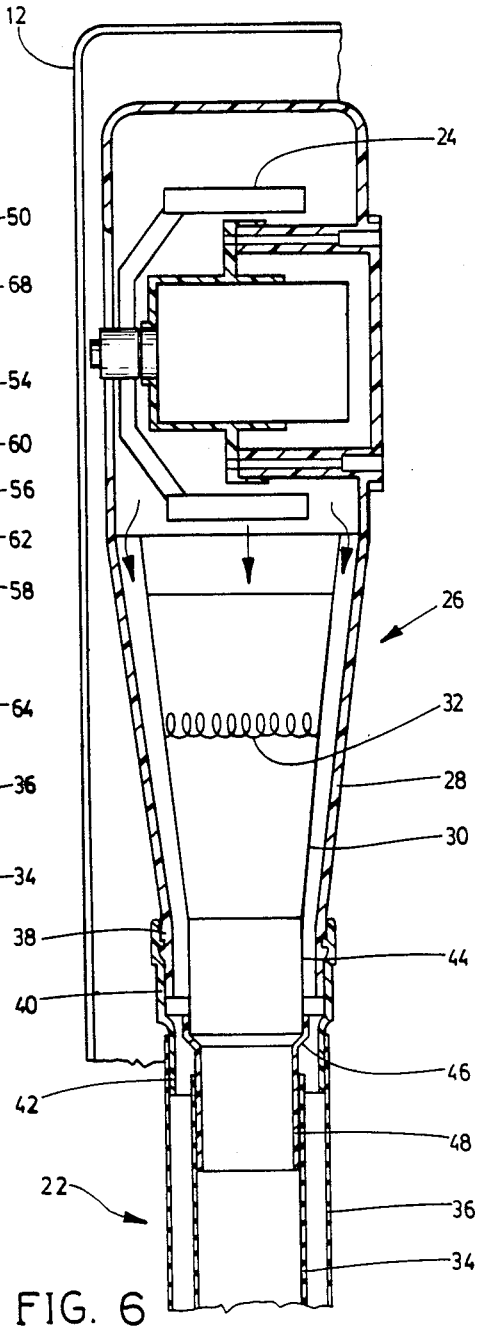

The conduit assembly 22 is attached to the flow divider 26 to receive both the heated and relatively cool air flows. As apparent in FIG. 6, the conduit assembly 22 comprises an inner conduit 34, and an outer conduit 36 which defines a flow path surrounding the inner conduit 34. The outer shell 28 of the air flow divider 26 is terminated with a tubular extension 38 which receives and supports an outer pipe fitting 40. The outer pipe fitting 40 has a sleeve 42 which closely receives the outer conduit 36 (locating against the interior cylindrical surface of the outer conduit 36). The inner shell 30 of the air flow divider 26 is terminated with a tubular extension 44 which receives and support an inner pipe fitting 46 (concentric with the outer pipe fitting 40). The inner pipe fitting 46 has a sleeve 48 which closely receives the inner conduit 34 (locating against the interior cylindrical surface of the inner conduit 34). Accordingly, the heated air flow is conveyed to the nozzle 20 by the inner conduit 34 and a relatively cool air flow is conveyed to the nozzle 20 in the air flow path defined by the outer conduit 36 around the inner conduit 34. Since heated air flows are confined entirely to the interior of the inner conduit 34, and since the inner conduit 34 is surrounded by a relatively cool air flow, the exterior of the conduit assembly 22 remains relatively cool to a user's touch during operation of the hair dryer 10.

The nozzle 20 is attached to the conduit assembly 22 in a manner which permits the nozzle 20 simultaneously to rotate relative to the end of the conduit assembly 22 about an axis transverse to the discharge air stream through the nozzle outlet and to receive and mix both the heated and relatively cool air flows prior to discharge. The rotation feature is important to permit easy manipulation of the nozzle 20 during hair drying and to facilitate return of the nozzle 20 to a storage recess formed in the housing 12 as described more fully below.

Figure 5:
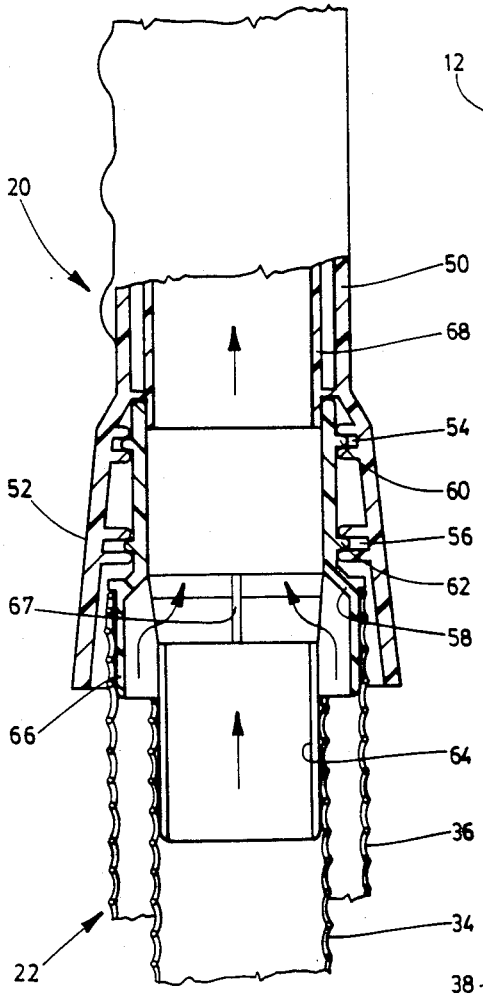
FIG. 5 is a cross-sectional view in a vertical plane illustrating an air flow producing assembly contained within the housing of the hair dryer; and, FIG. 6 is a cross-sectional view of the nozzle.

As apparent in FIG. 5, the nozzle 20 has a hollow outer casing 50 formed with a flared or frustoconical casing portion 52. The casing portion 52 has an inner surface formed with a pair of axially spaced-apart circular grooves 54, 56. A hollow inner casing 58 which serves to connect the inner and outer conduits to the nozzle 20 and to combine the heated and cool air flows is mounted in the interior of the frustoconical casing portion 52 in generally concentric relationship. The inner casing 58 has an outer surface formed with a pair of circular shoulders 60, 62 which are received in the circular grooves 54, 56 such that the inner casing 58 can be rotated by hand relative to the outer casing 50. The outer casing 50 has a two-part construction which permits such mating of the shoulders 60, 62 and the grooves 54, 56.

The inner casing 58 is terminated with inner and outer concentric sleeves 64, 66. The outer sleeve 66 closely receives an end portion of the outer conduit 36 and the inner sleeve 64 closely receives an end portion of the inner conduit 34. The inner sleeve 64 is secured to the rest of the inner casing 58 by plastic beams (such as the beam 67) which are spaced apart to define a passage permitting the relatively cool air flows received by the outer conduit 36 to be directed into and mingled with the heated air flows received by the inner sleeve 64. These are combined in an internal sleeve 68 spaced from the outer casing 50. The mixing of the air flows reduces the temperatures of the nozzle 20 which is to be hand manipulated and the provisions of the internal sleeve 68 spaced from the outer casing 50 provides an additional measure of insulation.

As mentioned above, this nozzle structure permits rotation of the nozzle 20 relative to the end of the conduit assembly 22 while simultaneously providing proper mixing of the heated and cool air flows to reduce the final temperature of the air discharged by the nozzle 20. It should be appreciated that the arrangement of complementary grooves 54, 56 and shoulders 60, 62 are an example of one set of complementary radially symmetric fittings which can be used to interfit the inner and outer nozzle casings for relative rotation, but other types can be substituted.

Figure 4:
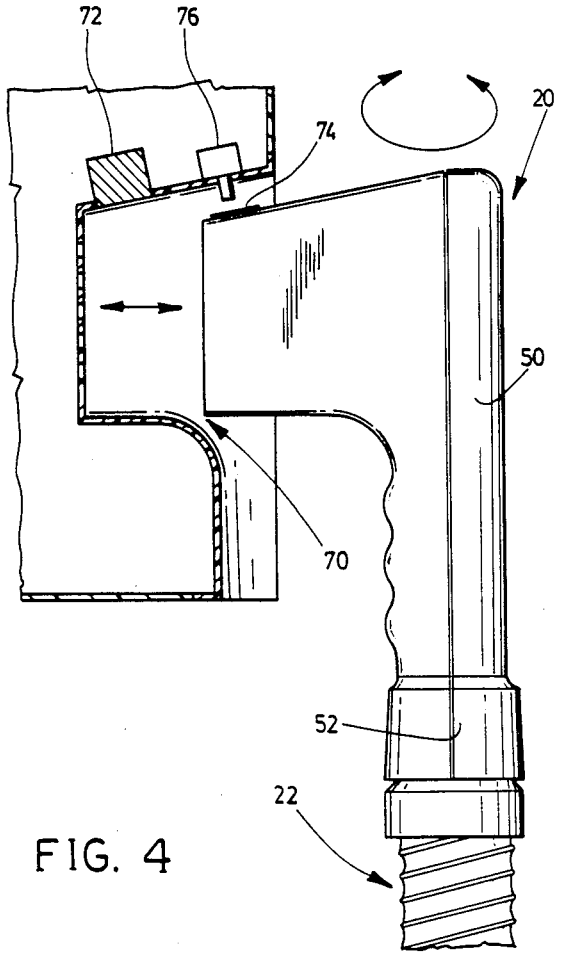
FIG. 4 is a fragmented view illustrating a nozzle storing arrangement associated with the hair dryer.

A recess 70 is formed to one side of the housing 12 to receive and store the nozzle 20. As apparent in FIG. 4, the recess 70 has a shape complementary to that of the nozzle 20. A magnetic fastener element 72 is mounted in the recess 70 and acts magnetically on a complementary magnetic material 74 on an upper nozzle surface to assist in retaining the nozzle 20 within the recess 70. An off/on switch 76 is also mounted in the recess 70. It is desirable that the air flow producer and heating element 32 not be operative after insertion of the nozzle 20 into the storage recess 70. The switch positioned to be tripped by the nozzle 20 during such insertion and to shut off operation of both the electric heating element 32 and the fan 24 in such circumstances.

Figure 2:
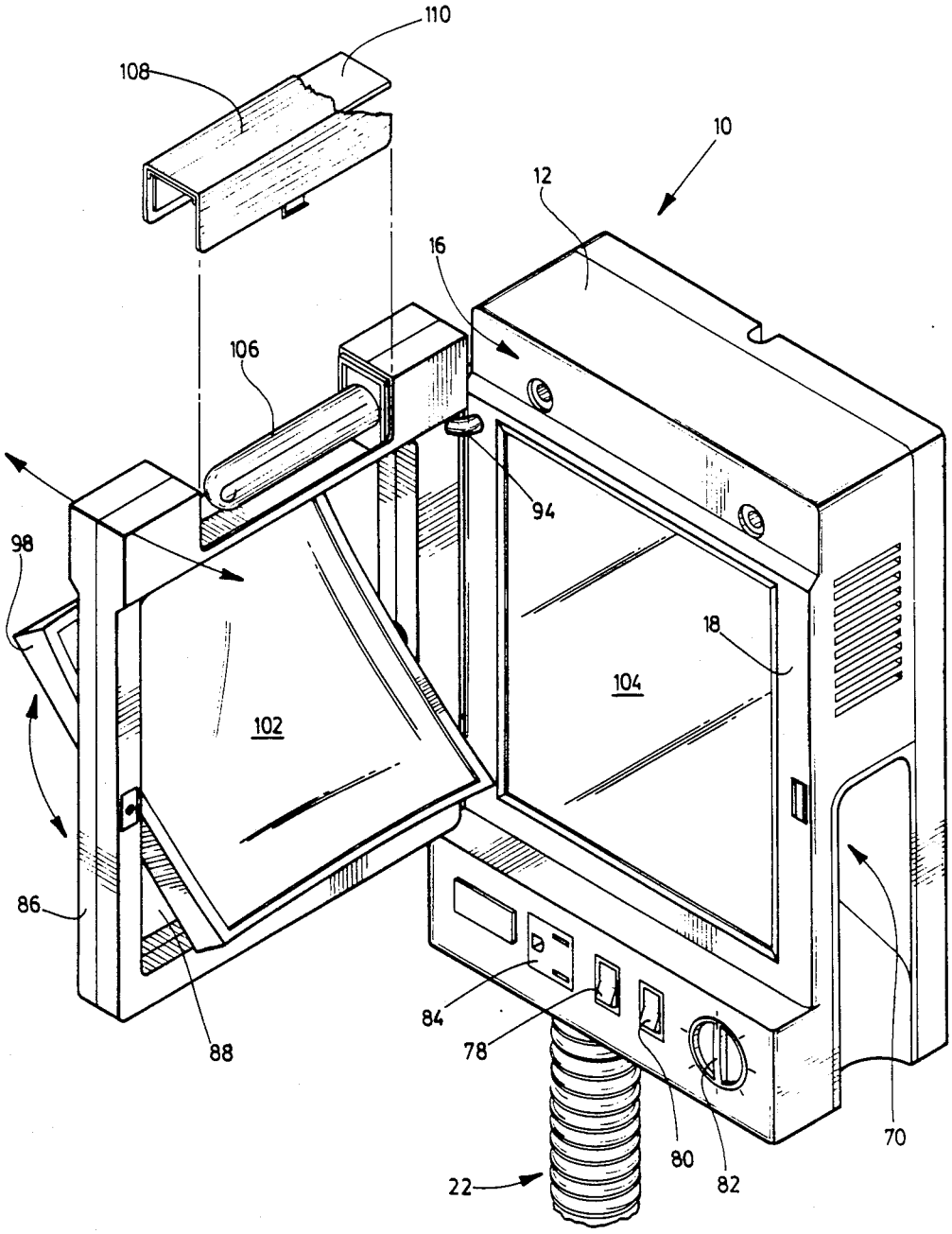
FIG. 2 is a perspective view of the hair dryer with a frame hinged to a forward recessed surface of the hair dryer in an open orientation.
Figure 3:
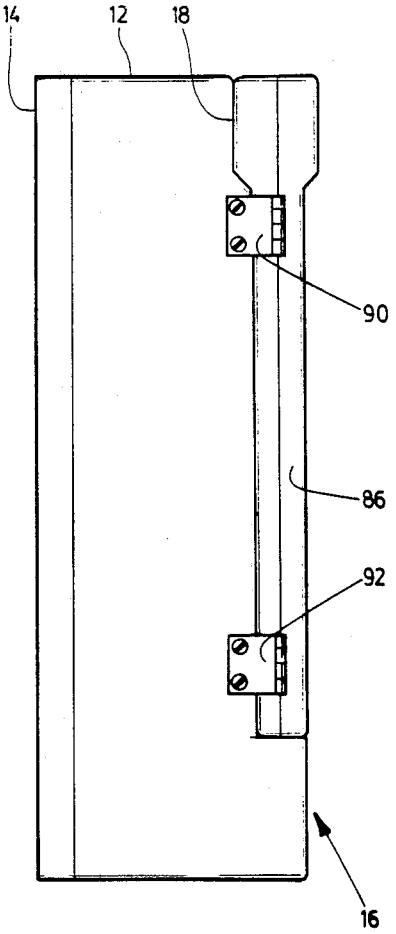
FIG. 3 is a side elevational view of the hair dryer.

Several controls are mounted on the lower forward surface 16 of the housing 12 to permit the operation of the hair dryer 10 to be regulated. A switch 78 permits adjustment of air flow rates between a high air flow setting and a low air flow setting. Another switch 80 permits selection of air flow temperature, once again a high setting and a low setting. A rotary switch 82 regulates the operating time of the dryer and serves as the primary on/off switch. As will be apparent in FIG. 2, a circumferential scale associated with the switch 82 indicates the duration of time for which the unit will be operable. This is an advantageous arrangement, particularly in connection with hotel rooms, because the hair dryer 10 cannot be left in an operative state for more than a limited period of time, the maximum time limit preferably being in the order of about ten minutes. As well, the housing 12 has a forward power outlet 84, making electric power available for small appliances such as a razor or the like.

A generally rectangular frame 86 with a rectangular central opening 88 is mounted with hinges 90, 92 in the recess associated with the forward housing surface. This permits hinged movement of the frame 86 about a generally vertical axis. Electric power is delivered to the frame 86 through a flexible cord 94 from the interior of the housing 12 for purposes of operating a lighting unit 96 mounted on the frame 86. A generally rectangular mirror assembly 98 is pivotably mounted with the central opening 88 for movement about a generally horizontal axis. The mirror assembly 98 has a forward, flat mirrored surface 100 and a rear mirrored surface 102 which is curved to provide an enlarging function. The forward and rear surfaces 100, 102 are of course interchangeable owing to pivoting action. It will be noted that the forward surface 16 of the housing 12 also includes a mirrored surface portion 104 which is exposed when the frame 86 is hingedly moved away from the recessed forward housing surface portion 18.

In the closed orientation of FIG. 1, the frame 86 seats unobtrusively in the recessed housing surface portion 18 and the mirrored surface 100 might be exposed. In the open orientation of FIG. 2, the frame 86 is separated from and angled relative to the forward housing surface. In the open orientation, the mirror assembly 98 can be pivoted to permit a user to properly orient the mirror assembly to focus on himself. In fact, the user will rely both on the vertical hinge connection associated with the frame 86 and the horizontal pivot connection associated with the mirror assembly 98 in order to locate one or the other mirrored surfaces 100, 102 for proper viewing. Accordingly, even if the hair dryer 10 is mounted on a wall over some structure which prevents the user from standing before the stationary mirrored surface portion associated with the forward housing surface, he can manipulate the frame 86 and mirror assembly 98 to obtain an appropriate reflecting surface for his use.

An upper peripheral portion of the frame 86 is recessed to contain the lighting unit 96. The lighting unit 96 comprises an incandescent lamp 106, a channeled cover 108 which fits over the lamp 106, and a reflector 110 which is attached to the cover 108. The reflector 110 reduces the transmission of light other than forwardly and rearwardly of the frame 86. Since the lighting unit 96 is configured to project light both forwardly and rearwardly of the frame 86, regardless how a user orients the frame 86 to obtain a reflecting surface from the mirror assembly 98, he has light directed towards him to facilitate hair styling or the like.

It will be appreciated that a particular embodiment of the invention has been described and that modifications may be made therein without departing from the spirit of the invention or necessarily departing from the scope of the appended claims.

I claim:

1. A hair dryer comprising:

a housing having a forward surface;

air flow producing means mounted in the housing for producing at least a heated air flow;

a nozzle;

conduit means for directing the heated air flow to the nozzle, the conduit means joining the nozzle to the housing and being flexible to permit movement of the nozzle relative to the housing;

a frame hinged to the housing such that the frame moves between a closed orientation in which the frame is positioned against the forward housing surface and an open orientation in which the frame is separated from and angled relative to the forward housing surface;

a mirror assembly including an opposing pair of parallel mirrored surfaces; and, means mounting the mirror assembly to the support frame for pivoting movement relative to the frame.

2. A hair dryer as claimed in claim 1 comprising an electrically-operable lighting unit mounted on the frame, the lighting unit being configured to deliver light both forwardly and rearwardly relative to the frame.

3. A hair dryer as claimed in claim 1 in which the conduit means comprise an outer conduit and an inner conduit, the heated air flow being confined to the interior of the inner conduit.

4. A hair dryer as claimed in claim 1 in which the housing comprises a recess shaped to receive the nozzle and switching means mounted within the recess and positioned to engage the nozzle when received in the recess for discontinuing delivery of air through the nozzle when engaged with the nozzle.

5. A hair dryer as claimed in claim 4 in which the nozzle comprises:

a first nozzle portion defining an air outlet;

a second nozzle portion fixed to the conduit means;

the first nozzle portion being rotatable relative to the second nozzle portion about an axis transverse to the direction of air flow through the air outlet.

6. A hair dryer as claimed in claim 1 in which:

the frame comprises a central opening;

the mirror assembly is mounted within the central opening for pivoting movement about a generally horizontal axis; and, the frame is hinged to the housing for hinged movement about a generally vertical axis.

7. a hair dryer as claimed in claim 6 comprising an electrically-operable lighting unit mounted on an upper edge portion of the frame above the mirror assembly, the lighting unit being configured to deliver light forwardly and rearwardly relative to the frame.

8. A hair dryer as claimed in claim 7 in which the lighting unit comprises a reflector positioned to prevent light from escaping from the lighting unit except forwardly and rearwardly relative to the frame.

9. A hair dryer as claimed in claim 1 in which:

the forward housing surface has a recessed surface portion;

the frame in the closed orientation in which the frame locates within the recessed surface portion.

10. A hair dryer as claimed in claim 1 in which the air flow producing means also produces a relatively cool air flow.

11. A hair dryer as claimed in claim 10 in which the conduit means comprise an inner conduit which delivers the heated air flow to the nozzle and an outer conduit which defines an air flow passage surrounding the inner conduit through which the relatively cool air flow is guided about at least the majority of the length of the inner conduit.

12. A hair dryer as claimed in claim 11 in which the air flow producing means comprise:

an electrically-operable fan unit producing an air stream from ambient air;

a flow divider for dividing the air stream into a first air flow directed to the interior of the inner conduit and a second air flow directed to the air flow passage surrounding the inner conduit; and, electrically operable heating means for heating the first air flow.

13. A hair dryer as claimed in claim 11 in which the nozzle comprises means for receiving and combining the heated air flow and the relatively cool air flow for discharge through the nozzle.

14. A hair dryer as claimed in claim 13 in which the air flow receiving and combining means comprise:

an inner sleeve which closely receives the inner conduit;

an outer sleeve which closely receives the outer conduit;

mounting means for securing the inner sleeve to the outer sleeve in substantially concentric spaced-apart relationship, the mounting means having a passage which directs the relatively cool air flow into the heated air flow for mixing.

15. A hair dryer as claimed in claim 11 in which the nozzle comprises:

a hollow outer casing having an internal circular groove;

a hollow inner casing having an external circular shoulder interfitted with the circular groove of the outer casing such that the inner casing can be rotated by hand relative to the outer casing, the inner casing having an outer sleeve which closely receives an end portion of the outer conduit.

16. A hair dryer as claimed in claim 15 in which the inner casing comprises an inner sleeve which closely receives an end portion of the inner conduit, the inner sleeve being substantially concentric with the outer sleeve.

17. A hair dryer as claimed in claim 16 in which the inner casing has a passage placing the interior of the outer sleeve in communication with the interior of the inner sleeve such that the relatively cool air flow is directed into the heated air flow within the nozzle.

18. A hair dryer as claimed in claim 11 in which the nozzle comprises:

a hollow outer casing having an inner surface formed with a first radially symmetric fitting;

a hollow inner casing having an outer surface formed with a second radially symmetric fitting interfitted with the first fitting such that the inner casing can be rotated by hand relative to the outer casing;

the inner casing having an outer sleeve which closely receives an end portion of the outer conduit and an inner sleeve which closely receives an end portion of the inner conduit, the inner casing having a passage placing the interior of the outer sleeve in communication with the interior of the inner sleeve such that the relatively cool air flow is directed into the heated air flow within the nozzle.

19. A wall-mounted hair dryer comprising:

a housing;

air flow producing means mounted in the housing for producing a heated air flow and a relatively cool air flow;

a nozzle;

a conduit assembly coupled to the air flow producing means for receipt of the heated air flow and the relatively cool air flow, the conduit assembly joining the nozzle to the housing and being sufficiently flexible as to permit movement of the nozzle by hand relative to the housing;

the conduit assembly including an inner conduit which delivers the heated air flow to the nozzle and an outer conduit which defines an air flow passage surrounding the inner conduit through which the cool air is guided about at least the majority of the length of the inner conduit.

20. A hair dryer as claimed in claim 19 in which the air flow producing means comprise:

an electrically-operable fan unit producing an air stream from ambient air;

a flow divider for dividing the air stream into a first air flow directed to the interior of the inner conduit and a second air flow directed to the air flow passage surrounding the inner conduit; and, electrically operable heating means for heating the first air flow.

21. A hair dryer as claimed in claim 19 in which the nozzle comprises means for receiving and combining the heated air flow and the relatively cool air flow for discharge through the nozzle.

22. A hair dryer as claimed in claim 21 in which the air flow receiving and combining means comprise:

an inner sleeve which closely receives the inner conduit;

an outer sleeve which closely receives the outer conduit;

mounting means for securing the inner sleeve to the outer sleeve in substantially concentric spaced-apart relationship, the mounting means having a passage which directs the relatively cool air flow into the heated air flow for mixing.

23. A hair dryer as claimed in claim 19 in which the nozzle comprises:

a hollow outer casing having an internal circular groove;

a hollow inner casing having an external circular shoulder interfitted with the circular groove of the outer casing such that the inner casing can be rotated by hand relative to the outer casing, the inner casing having an outer sleeve which closely receives an end portion of the outer conduit.

24. A hair dryer as claimed in claim 23 in which the inner casing comprises an inner sleeve which closely receives an end portion of the inner conduit, the inner sleeve being substantially concentric with the outer sleeve.

25. A hair dryer as claimed in claim 24 in which the inner casing has a passage placing the interior of the outer sleeve in communication with the interior of the inner sleeve such that the relatively cool air flow is directed into the heated air flow within the nozzle.

26. A hair dryer as claimed in claim 19 in which the nozzle comprises:

a hollow outer casing having an inner surface formed with a first radially symmetric fitting;

a hollow inner casing having an outer surface formed with a second radially symmetric fitting interfitted with the first fitting such that the inner casing can be rotated by hand relative to the outer casing;

the inner casing having an outer sleeve which closely receives an end portion of the outer conduit and an inner sleeve which closely receives an end portion of the inner conduit, the inner casing having a passage directing the relatively cool air flow into the heated air flow within the nozzle.

* * * * *